United States Patent [19]

Hillsted

[11] Patent Number: 4,928,510

[45] Date of Patent: May 29, 1990

[54] RING COILING MACHINE

[75] Inventor: Jerome Hillsted, Blaine, Minn.

[73] Assignee: Merit Enterprises, Inc., Isle, Minn.

[21] Appl. No.: 407,591

[22] Filed: Sep. 15, 1989

[51] Int. Cl.[5] ..... B21F 37/00

[52] U.S. Cl. ..... 72/131; 140/88

[58] Field of Search ..... 59/20; 140/71 R, 71 C, 140/88, 92, 92.3, 92.4, 93 R; 72/131

[56] References Cited

U.S. PATENT DOCUMENTS 1,649,600 11/1927 Kiwi ..... 140/92.3

2,149,942 3/1939 Prentice ..... 72/131

2,855,974 10/1958 Heckethorn ..... 72/131

4,030,327 6/1977 Collins et al. ..... 72/131

4,391,115 7/1983 Slattery et al. ..... 72/131

FOREIGN PATENT DOCUMENTS 16874 11/1970 Japan ..... 140/88

*Primary Examiner*—Lowell A. Larson

*Attorney, Agent, or Firm*—Leo Gregory

[57] ABSTRACT

A wire feeding machine automatically forming a coil through an aperture in a product.

2 Claims, 7 Drawing Sheets

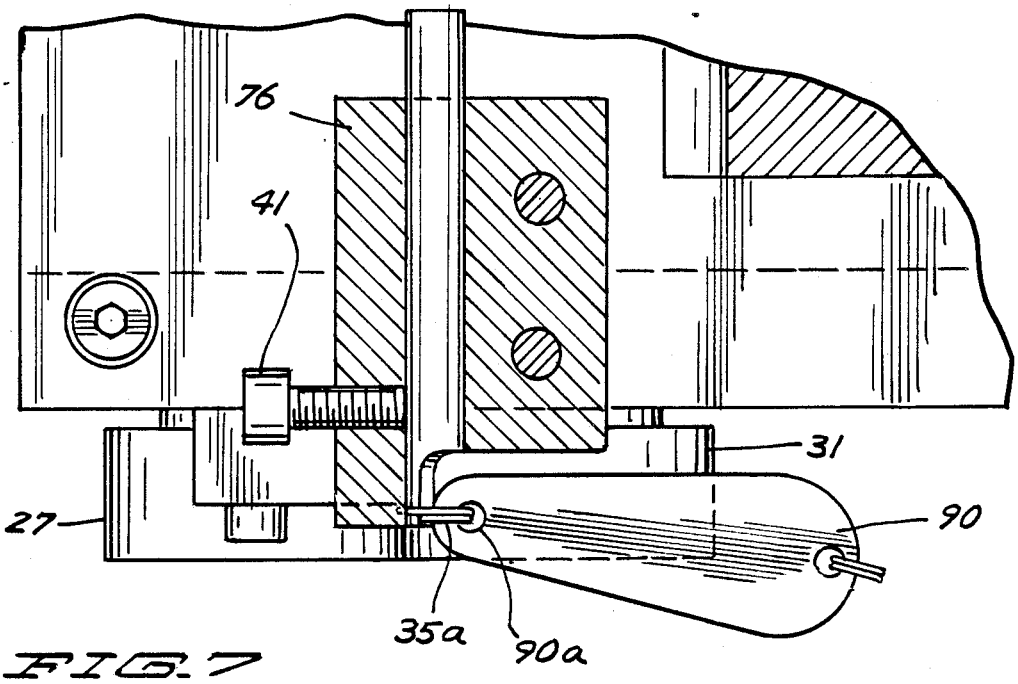
FIG. 7
FIG. 6
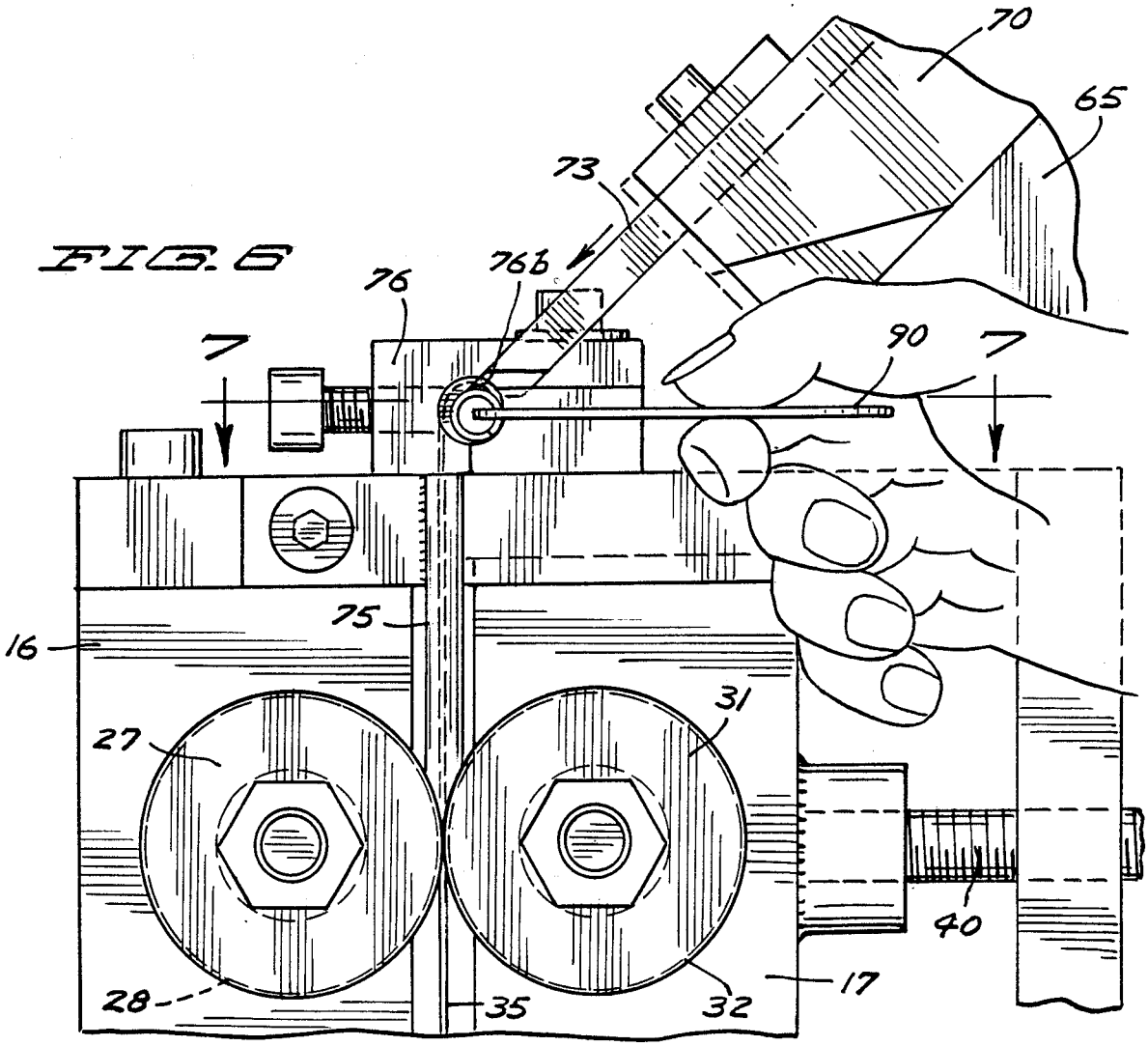

FIG. 9
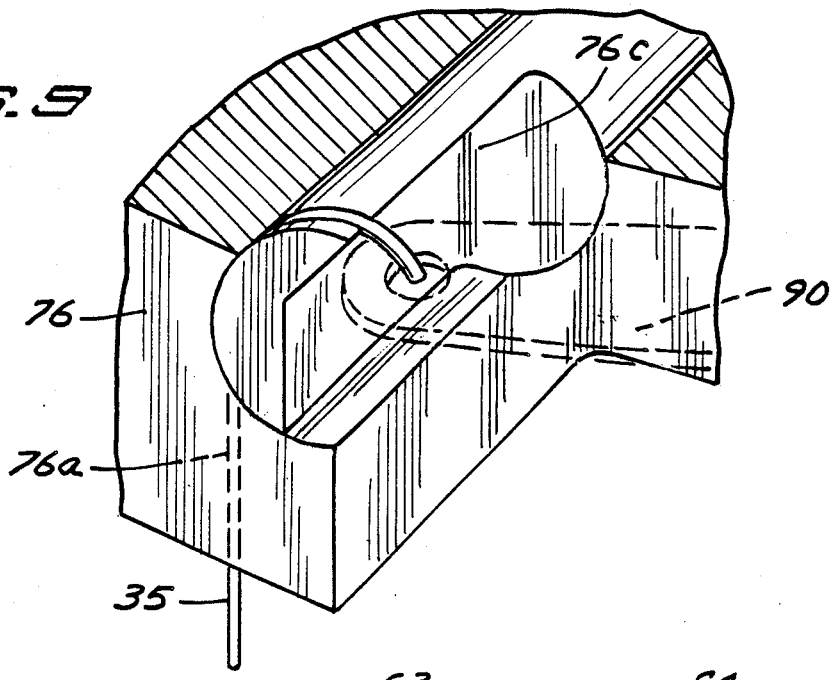
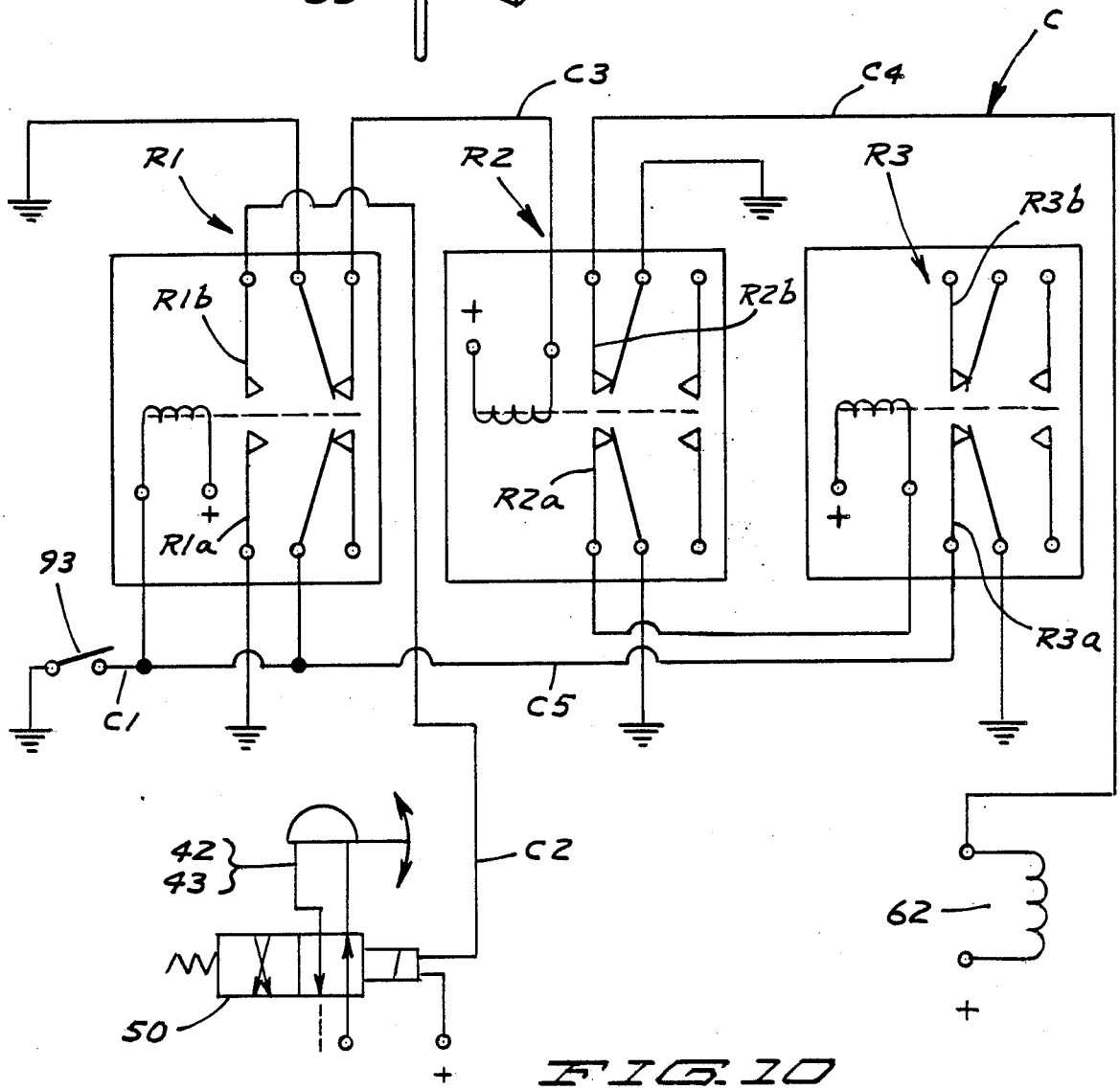
FIG. 10

RING COILING MACHINE

BACKGROUND OF THE INVENTION

1. Field of Invention

The automatic making and extending a coil of wire through an aperture in a product.

2. Brief Description Of The Previous Art

It is desirable as for fishing purposes to have a coil of wire through the eyelits of a hook or a lure to connect the same or for purposes of securing a fishing line thereto.

Further there is no known machine or automated process for threading a wire coil as through the eyelit of a fishing lure or hook.

It is costly and a slow process to coil a wire by hand as through the eyelits of a lure or a hook or to connect the two.

SUMMARY OF THE INVENTION

It is desirable to have an object of this invention to provide an automated device which will thread and form a coil of wire through the aperture or eyelit as of a fishing lure and a hook.

It is more particularly an object of this invention to provide a wire coiling machine adapted to coil a wire through an aperture in a product or products such as the aligned held eyelits of a fishing lure and a fish hook to connect the same.

Further it is also an object, with reference to the previous object, that such a machine be foot operated and that it cut off the coil after having made on the order of 2½ turns through said eyelits and that in cutting the coil in a subsequent step it projects a stub of wire to receive the eyelits to position the same to receive the coil of wire for the next cycle of operation.

These and other objects and advantages of the invention will be set forth in the following description made in connection with the accompanying drawings in which like reference characters refer to similar parts throughout the several views.

BRIEF DESCRIPTION OF THE DRAWINGS

FIG. 6 is a broken view similar to FIG. 1 with a portion broken away showing an operational step;

FIG. 7 is a broken view in section taken on lines 7—7 of FIG. 6 as indicated showing an operational step.

FIG. 9 is a broken view similar to FIG. 8 showing another detail of operation;

FIG. 10 is a schematic wiring diagram.

DESCRIPTION OF A PREFERRED EMBODIMENT

Figure 1:
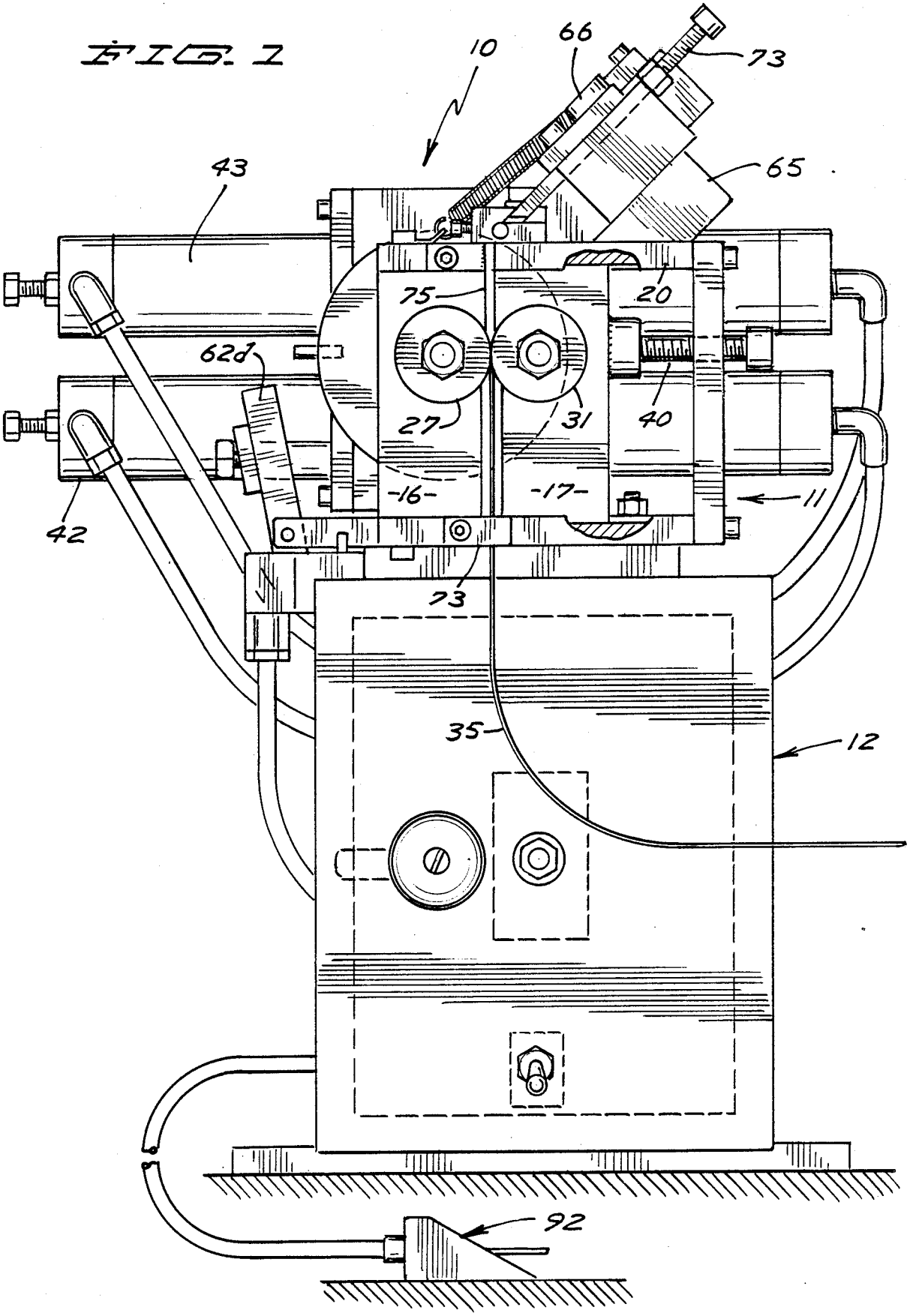
FIG. 1 is a view in elevation of one end of the machine comprising the invention.

Referring to the drawings the machine comprising the invention herein is here shown forming a coil of wire through the eyelit of a fishing lure and is indicated generally by the reference numeral 10 in the various views in which it is shown.

Said machine is shown supported upon a cabinet 12.

The housing 11 of said machine is a frame comprising an elongated base plate 14 and at the forepart thereof are spaced end walls 16, 17 and 18, 19 supporting a top wall or plate 20 and at the rear thereof are corner supports or walls 22 and 23.

Mounted between said spaced end walls and journaled therein and extending through the walls 16 and 17 are shafts 26 and 30 and respectively having mounted on their extended portions the rollers 27 and 31 adapted to rotate in opposite directions by a gear train, as will be described and having very little clearance therebetween. Spaced inwardly from the outer end of each roller are annular grooves 28 and 32. Said grooves are of such little depth as merely to serve as guides for a wire 35 fed therebetween as in FIG. 6. Said rollers will advance said wire 35 by frictional engagement through a tube 75.

Mounted on said shafts 26 and 30 adjacent the inner sides of said walls 17 and 18 are meshing gears 37 and 38 comprising the gear train which upon being driven cause said shafts and their respective rollers to rotate in opposite directions and thus advance the wire 35.

Said walls 17 and 19 supporting the shaft 30 are transversely adjustable relative to the walls 16 and 18 by set screws 40 and 41 tapped through the end supports 22 and 23 to adjust the spacing between said rollers 27 and 31.

The shaft 26 extends outwardly of the wall 18 at **26*a* to an assembly of pneumatic rotary actuators 42 and 43 suitably mounted upon said base plate 14 and being carried by a central housing 45 as shown in FIG. 6. Said actuators have connected thereto the respective ends of air hoses 46, 47 and 48, 49. Said hoses will be connected to a suitable pressurized air supply as indicated at 50 and 51**, the control and operation of which will be described and which is indicated as being an electric-air switch.

Said actuators are commercially available under the trade name BIMBA PNEUTURN ROTARY ACTUATORY.

Figure 3:
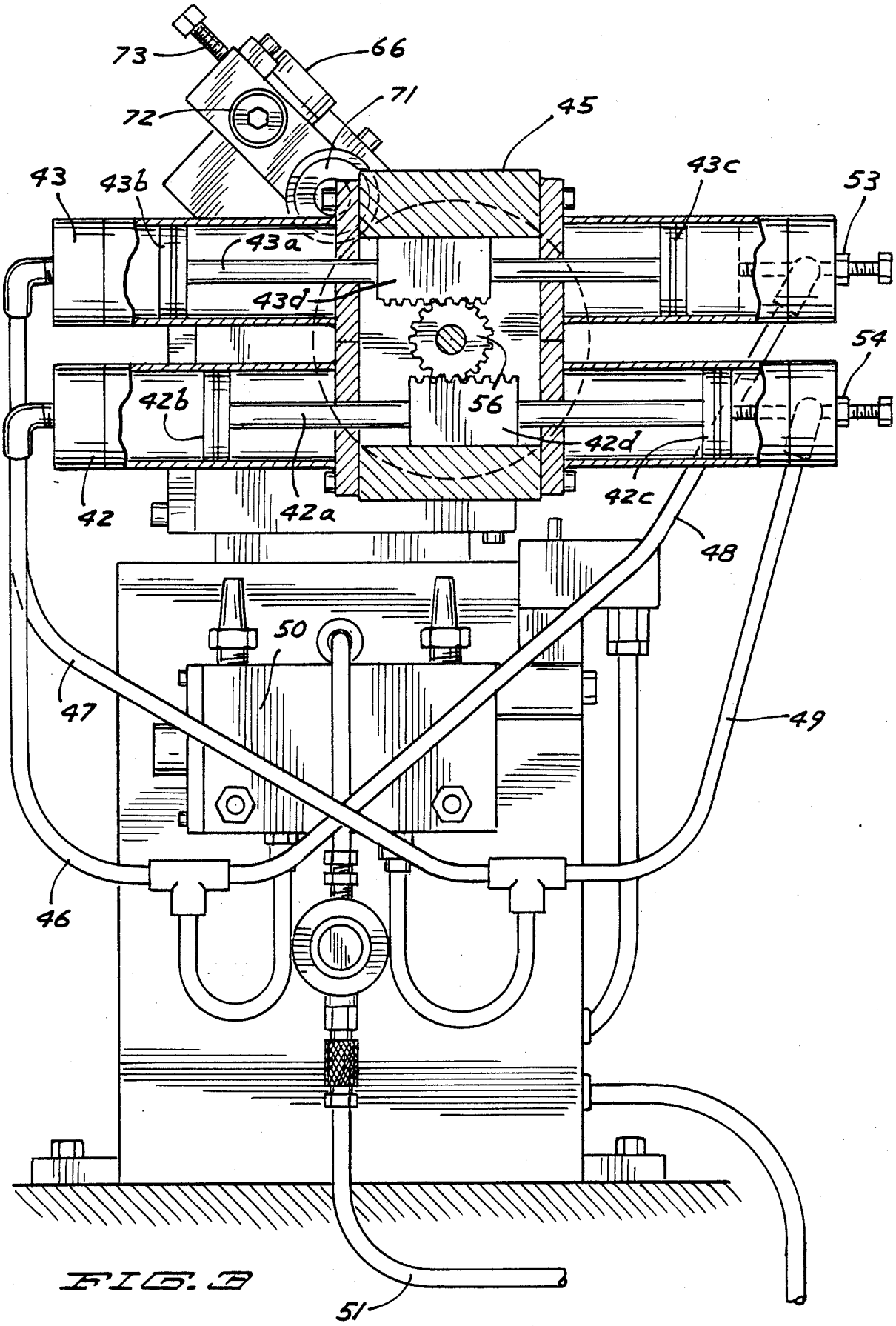
FIG. 3 is an elevational view of the other end of the machine.
Figure 5:
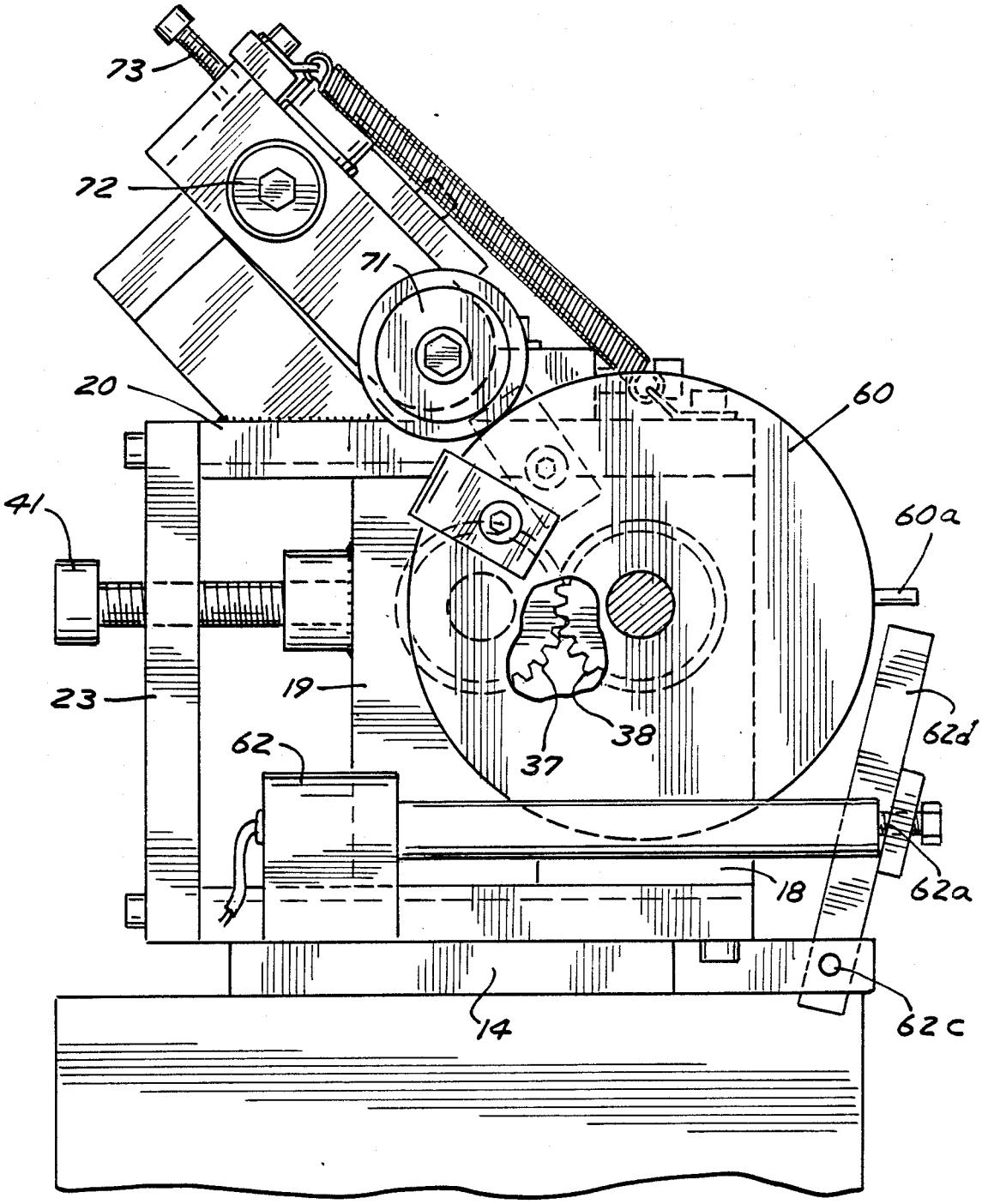
FIG. 5 is a view in elevation taken on lines 5—5 of FIGS. 4 and 5 as indicated.
Figure 4:
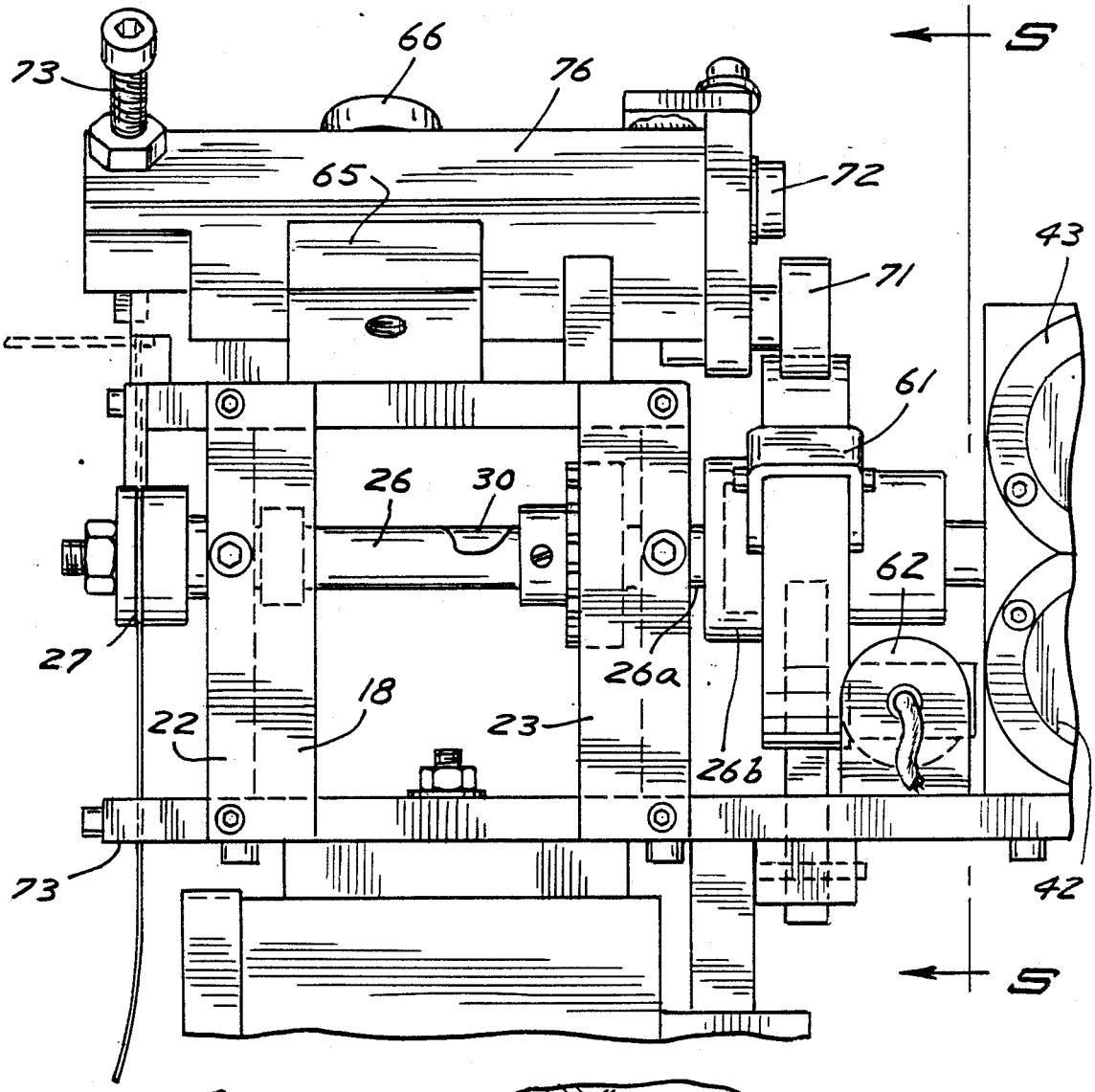
FIG. 4 is an elevational view of the other side of the machine with a portion broken away.

As illustrated in FIG. 3, said actuators include respectively shafts **42*a* and 43*a* having mounted at the respective ends thereof pistons 42*b*, 42*c* and 43*b*, 43*c***.

Set screws 53 and 54 at one end of each actuator adjust the travel of said shafts.

Within said housing 45 as shown in FIG. 3, carried respectively by said shafts **42*a* and 43*a* are gears 42*d* and 43*d* which are interengaged by the spur gear 56** and form part of the mentioned gear train.

Mounted onto said shaft extension **26*a* between said wall 18 and said housing 45 is a timing disc 60 which carries a cam lobe 61*a*. A clutch 26*b* is suitably mounted about and arranged to rotate the shaft 26 by forward movement of the piston 43*a* to the right as seen in FIG. 3. With the return movement of said shaft, said clutch slips about the shaft 26. Said clutch is in driving engagement with the spur gear 56**.

It is noted that the shafts **43*a* and 42*a* move oppositely of one another, the shaft 42*a* being adapted to return the shaft 43*a* to its commencing operating position to advance the wire 35**.

Projecting forwardly and outwardly of said disc 60 is a stop pin **60*a***.

A solenoid 62 is mounted on said base plate 14 adjacent said disc 60 and is shown having a piston **62*a* disposed along said disc to operate a stopping member 62d which is pivoted at 62c to the base plate member 14 and which has a laterally angled body portion extending across the end of said disc 60 adapted to engage said stop pin 60a**. This is used to permit the actuator to project a short length of wire as will be described.

Said piston 62a is pulled inwardly against an internal repelling spring not shown.

A laterally tilting operating plate 70 is mounted onto a block 65 secured thereto by a suitable pivot 66. Said block is secured to the top wall 20.

At the left of said plate 70 as viewed from the front is a coil spring 67 secured at one end to a bolt 68 at the upper end of said plate and secured at its other end to a bolt 69 in the front ledge of the housing 11.

Suitably secured and extending outwardly of the top plate 20 is a cam roller 71 engaged by said disc 60. Extending outwardly of said operating table 70 and suitably secured thereto is a roller 72 spaced above said roller 71 and positioned to be engaged by the cam portion thereof to tilt said plate 70 at predetermined intervals as will be further described. Said plate is returned by action of the spring 67.

Figure 2:
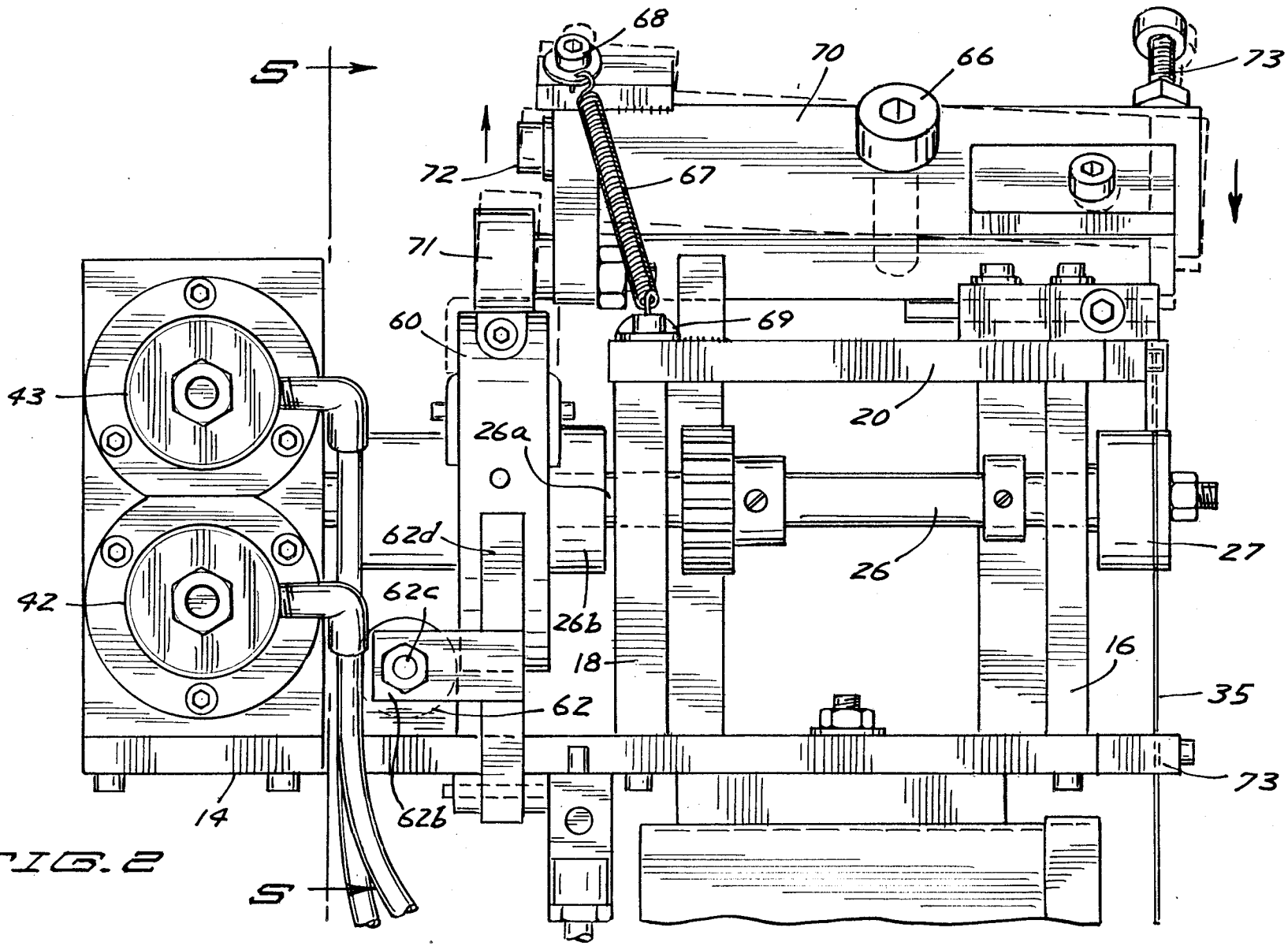
FIG. 2 is an elevational view of one side of the machine.

Carried at the right hand end of said operating table 70, as viewed in FIG. 2 and as shown in FIG. 6, and being threaded therethrough for adjustment and being substantially vertically positioned is a chisel-like wire cutting member 73.

Mounted onto the edge of said base plate above said rollers 27 and 31 is a block 76 forming a wire die having a passage or slot 76a to receive a wire having its upper portion 76b curved and enclosed to give the wire passing through a radius. The wire enters a cavity 76c to be formed therein, as shown, as a coil as at 35a. Said cutting member is adapted to sever the wire as it emerges from the passage 76a upon completion of the coiling of the wire.

Figure 8:
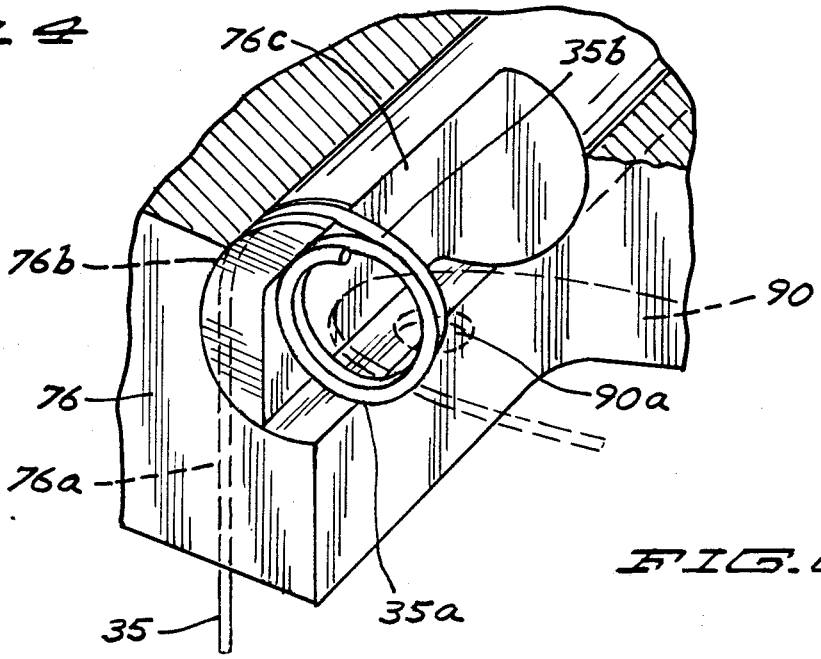
FIG. 8 is a broken view in perspective showing a wire coiling step.

An exaggerated view is shown in FIG. 8 to illustrate the passage of said wire into said cavity and the coiling of said wire. Also shown as a part of the coiling operation is the positioning of by hand of a lure 90 for the insertion of a coil through the eyelit 90a thereof. For purposes herein it has been found that two and one half coils are ample.

In the final step in the coiling of the wire, a short length of wire such as of an eighth of an inch will be projected as a final step to guide the operator in positioning the eyelits of the next lure to be positioned.

A foot pedal 92 is used in connection with the circuitry which will be described.

The mechanical steps in the operation will first be described and thereafter the electrical circuitry in connection therewith.

In operation, a length of wire 35 is fed between the rollers 27 and 31 and moved by said rollers into the die 76 through a passage 76a therethrough. Said passage and the cavity 76b into which it emerges are adapted to give the wire a radius and causes it to coil within said cavity.

The actuator 43 is then operated by the air-electric switch 50 and the actuator through the gear trains above described rotates the shafts 26 and 30 causing them to rotate the rollers 27 and 31 to advance or feed the wire 35 into the die 76.

Associated with the indicated gear train is a timing disc 60 which engages a cam roller 71 which in turn engages a shoulder bolt 72 mounted to tilt or rock the table 70 against the tension of the spring 67 when engaged by the cam lobe of the roller 71.

The table upon tilting or rocking causes the cutter 73 to descend and sever the wire at the point at which it emerges from the die passage 76b timed to do so upon the completion of one cycle of forming a coiling of the wire which in the present embodiment is on the order of two and one half turns or coils of the wire.

In completing one coiling operation, the actuator 43 is retracted as has been indicated. However as will be further described, said actuator will cause the wire to be advanced a short length as on the order of one eighth or one quarter inches to permit to be aligned with it the next item to have a coil formed through an aperture therein. This action of the actuator is cut short of its full length of travel by the timing disc 60 which moves with the actuator and the stop pin 60 projecting therefrom is engaged by said solenoid actuated stop member 62b so as to permit only a prescribed short advance of the wire. Thereafter, said actuator 43 is again retracted and one cycle of operation is completed.

The electrical circuitry C will now be described in relation to the above described mechanical operation.

The principal items in the circuitry are three relays, namely, R1, R2 and R3. The relay R2 has alternate action impulse response, a single input and a memory. The relays R1 and R3 are impulse responsive single input relays. These relays are of a type produced commercially by Potter and Brumfield and are well known in the art.

The operation electrically is commenced by the operator depressing or stepping upon the foot pedal 92 which turns on the switch 93 and this activates through circuit C1 the relay R1 which is characterized as an INTERVAL ON TIME DELAY relay. The relay is latched with its contact R1*a* to remain energized for the entire time of delay which is the interval of one cycle in making a coil ring as of two and one half turns of wire. The coiled spring will have a convenient diameter.

A foot tap on the pedal 92 pulls in contact R1*b* of said relay R1 which completes a circuit C2 to the switch 50 which operates the actuators 42 and 43. The actuator 43, through the gear train previously described, causes the rollers 27 and 31 to rotate and advance the wire 35 a pre-determined length to form the coil 35a and to cause the coil to be severed from the wire 35.

When the coil is completed, the interval on time delay of relay R1 is due to expire. However with the retraction of the actuator 42, the alternate action relay R2 becomes energized with its contact R2*b* completing a circuit with the stop solenoid 62. The other contact R2*a* of this relay energizes the Delay relay R3 and its contact R3*a* which after the time delay has expired energizes the foot pedal circuit and relay R1 and its contact R1*b* are energized to keep the circuit C2 energized for a sufficient length of time to have the actuator 43 advance the wire 35 a very short length, just enough to allow the operator to align the next item to have a coil formed therethrough. When the wire has been advanced sufficiently, the stop arm 62d of said solenoid will engage the stop pin 60a of the timing disc 60 of said solenoid and a full cycle will have been completed and the circuitry is de-activated. The next cycle is commenced by the operator again fully depressing the foot pedal 92.

The operator has only to step on the pedal at the start of each cycle. This is a great improvement over having the foot maintain constant pressure upon the foot pedal throughout the full operation of a cycle.

It will of course be understood that various changes may be made in the form, details, arrangement and proportions of the product without departing from the scope of the invention which, generally stated, consists in a product capable of carrying out the objects above set forth, in the parts and combination of parts disclosed and defined in the appended claims.

What is claimed is:

1. An automatic ring coiling machine, having in combination actuating means mounted within a housing, means operating said actuating means, timing means in connection with said operating means, wire advancing means, a wire advanced by said last mentioned means, a die member in operative association with said wire advancing means having a wire passage therethrough and a cavity therein, said passage and said cavity respectively being adapted to apply a radius to said wire and to coil the same, means operatively associated with said die severing said coil from said wire, said timing means comprises a pre-set operating time interval, means in connection with said timing means extending said pre-set timing interval, said actuating means causing the advance of said wire upon completion of a coil, and means limiting said advance of said wire to a very short projection from said passage in said die.

2. An automatic ring coiling machine, having in combination, a pair of actuators mounted within a housing, a wire advancing means in connection with a wire supply, a gear train connecting said actuators with said wire advancing means, means actuating said actuators to drive said gear train to operate said wire advancing means, means receiving wire from said wire advancing means forming a wire coil, means severing said coil from said wire, means caused by said actuators to operate said wire severing means, means returning said actuators to starting position, a timing disc in said gear train, a stop pin projecting from said timing disc, a solenoid having a stop member engaging said stop pin, and means actuating said solenoid to engage said stop pin and limit the movement of said actuators to cause said wire to be advanced a limited length.

* * * * *